United States Patent [19]

Pöntelin

[11] 4,313,480

[45] Feb. 2, 1982

[54] FIREWOOD CHOPPER

[76] Inventor: Jaakko Pöntelin, 54920 Taipalsaari, Finland

[21] Appl. No.: 159,164

[22] Filed: Jun. 13, 1980

[30] Foreign Application Priority Data

Jun. 15, 1979 [FI] Finland ..... 791906

[51] Int. Cl.[3] ..... B27L 7/00

[52] U.S. Cl. ..... 144/193 R; 83/675; 144/323

[58] Field of Search ..... 144/162 R, 176, 193 R, 144/3 R, 323, 326 R, 193 D, 3 K, 193 F; 83/391, 394, 332, 333, 334, 335, 336, 663, 665, 666, 672, 675

[56] References Cited

U.S. PATENT DOCUMENTS

| | | | |
|---|---|---|---|
| 2,520,286 | 8/1950 | Pietsch | 83/675 |
| 3,285,304 | 11/1966 | Fuller | 144/193 |
| 3,470,783 | 10/1969 | Tallving | 83/672 |
| 4,053,004 | 10/1977 | Barwise et al. | 144/174 |
| 4,273,171 | 6/1981 | Spaulding, Sr. | 144/193 A |

FOREIGN PATENT DOCUMENTS

| | | |
|---|---|---|
| 908790 | 4/1954 | Fed. Rep. of Germany . |
| 2334861 | 1/1975 | Fed. Rep. of Germany . |

*Primary Examiner*—W. D. Bray
*Attorney, Agent, or Firm*—McGlew and Tuttle

[57] ABSTRACT

A wood chopper is disclosed for splitting, cutting and chopping firewood and the like which includes a rotating or reciprocating blade which cooperates with a stationary blade to simultaneously split and cut wood. The blade includes a sharp edge portion extending along a major axis of the wood which widens backwardly away from a direction of movement of the blade toward heel portions of the blade. The fixed blade is V-shaped and supports the wood to be cut. The heel portions of the blade may also be sharpened. The blade edge splits the wood and simultaneously urges the wood against the fixed blade so that the wood is split and cut in a single operation.

9 Claims, 2 Drawing Figures

FIREWOOD CHOPPER

FIELD AND BACKGROUND OF THE INVENTION

The present invention relates to a firewood chopper for producing chips, chopped firewood and the like employing a method where the wood material can be both cut and split during one and the same operation. The chopping material can consist of all kinds of small blocks and pieces of wood, such as lathes, branches, tree spires, slender trunks, etc. The chopper comprises a rotating or back-and-forth moving blade as well as a stationary counterblade, and the wood is chopped between the two blades.

The prior art contains several suggestions for choppers, which are intended for the chopping of small pieces of wood. Swedish patent publication No. 113 901 describes a chopper which is particularly suited for producing chips to be used in gas generators. This chopper includes a motor-run balance wheel, to which is hitched a cutting blade. The wood infeed gutter is placed in a slightly slanted position compared to the motion plane of the blade. The infeed gutter supports the wood from underneath while the rotating blade chops slices at its end. There are small splitting blades attached to the big cutting blade at right angles to it, which splitting blades simultaneously split the cut-off slices of wood.

One of the drawbacks of the above described arrangement is its comparatively great power demand. This is partly due to the fact that the chopping is carried out using a straight blade which is oriented almost vertically with respect to the wood fibres. In order to function satisfactorily the blade has to rotate at a comparatively high speed, and this increases the power demand. Moreover, by employing the above described arrangement it is hardly possible to produce, for example, chopped firewood pieces having the length of 35–50 cm so that the pieces are also split. The reason for this is the fact that the splitting blades are too small and wrongly placed for this purpose.

In the German patent publication Nos. 633 018 and 908 790 are introduced choppers which are also meant to be used in the production of chips for wood gas generators. The arrangement described in this publication comprises two oppositely rotating drums, on the outer surface of which are placed blades in a radial fashion. The rotating movement of the two drums is synchronized so that the pieces of wood are cut into suitable slices between the blades attached to the two opposite drums. Attached to each cutting blade there is also a splitting blade at right angles to the cutting blade, the purpose of which is to split the choppings simultaneously with the cutting operation.

In the latter publication is described a chopper which includes a blade which moves back and forth along a straight line, and a V-shaped guard plate. The blade is driven, for example, by a hydraulic cylinder. The cutting blade has splitting blades mounted at right angles to it.

The drawbacks of the above described arrangements include, among other things, their great cutting power requirements which also result in the need for structure to be massive and strong. Also, it is doubtful whether the device represented in the patent publication No. 908 970 could split the choppings in case their length should approach half a meter. This is due to the incorrect positioning of the splitting blades.

SUMMARY OF THE INVENTION

The purpose of the present invention is, among other things, to avoid the above mentioned drawbacks. This is possible by using an arrangement according to the present invention, characterized by the features described in the patent claim. Compared to the previous art devices, the present invention has for instance the advantage that even long trunks of wood are thoroughly split. Moreover, the power demand is comparatively small. Because the cutting is based on pressing rather than hitting, as is the case in previously known devices, it is possible to use a lighter build in the structure of the device.

The invention and its various advantages are explained in the following in detail with references to the appended drawing.

DESCRIPTION OF PREFERRED EMBODIMENT

Figure 1:
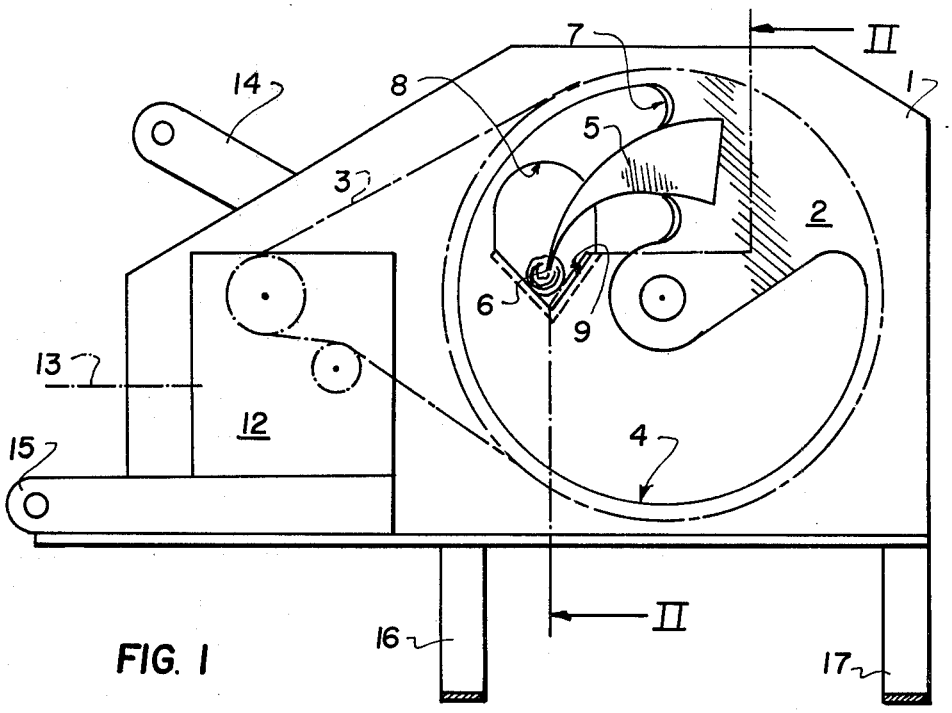
FIG. 1 is a side elevational view of one preferred embodiment of the invention
Figure 2:
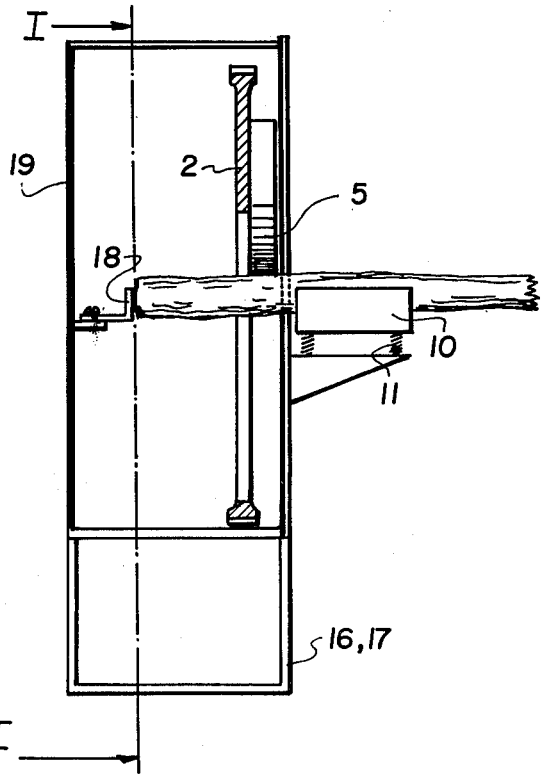
FIG. 2 is an illustration of the same device as in FIG. 1, taken along the line II—II.

According to FIG. 1 a chopper comprises the plate-like body 1. A blade wheel 2 is attached, with bearings, to the body 1. The blade wheel is rotated by employing the gearing chain 3 placed on its orb. An opening is formed in between the orb and hub of the blade wheel. To the borders of the opening is fixed the rotating blade 5. The blade 5 is narrow and wedge-shaped, widening gradually from the peak 6 toward the heel. The center line of the blade is roughly a circle, so that the blade peak 6 is pointed towards the rotating direction of the wheel blade.

The edge of the blade peak 6 is roughly parallel to the piece of wood to be chopped, which in the FIG. 1 means that it extends vertically from the paper plane. From the edge 6 onwards, the blade becomes wider and is smoothly joined to the border of the opening 4 in the blade wheel 2, so that the border 7 of the opening 4 functions as the heel of the blade. The border 7 is also preferably sharpened.

The body 1 has a hole 8, through which wood is fed into the chopper. The lower edge of the hole 8 is designed as a downwardly narrowing, preferably V-shaped cutting blade 9. The cutting blade 9 is stationary and is fixed to the body 1 and preferably sharpened only on the side where wood is fed in. In order to make the feeding easier, there is a wood infeed gutter 10 attached to the side of the chopper. The infeed gutter 10 is fixed to the body flexibly by springs 11. The length of the wood material to be fed in can be adjusted as desired by employing a back stop 18.

The operating chain 3 of the wheel blade is run by employing a bevel gear arrangement 12. The gear 12 is switched to some suitable power generator, for example agrimotor, with a cardan axle 13. The chopper is connected to the agrimotor, and preferably to its jibs, with the brackets 14, 15. In operation the chopper is positioned on the ground resting on its supporting feet 16, 17. The whole chopper is encased in sheathing 19, with only the wood infeed hole 8 open. Naturally the sheathing is also open underneath to inable the chopped pieces of wood to fall on the ground.

The chopper according to the invention operates in the following manner. The blade wheel 2 is started together with the rotating blade 5 attached to it. The piece of wood to be chopped is pushed against the back stop 18. The blade 5 hits the piece of wood and begins to penetrate it. The cutting edge of the blade is parallel with the piece of wood, and therefore the blade easily cuts the wood, simultaneously splitting it as well. In this preliminary phase the proper cutting off has not yet taken place, although the block to be cut is underneath supported by the stationary blade 9. As the blade 5 sinks further and further into the wood, the wood material on both sides of the blade is forced outwardly, against the stationary blade 9. Now the blade 5 chocks the wood into two pieces against the stationary blade 9. In this case the whole chopping process takes a comparatively long time, and the machine structures do not suffer from heavy impact strain. It is to be noted that the rotating speed of the blade wheel is rather low, less than 1 rps. Owing to this the power demand is also comparatively small and, over all, the device is safe to use.

According to one preferred embodiment it is advantageous to shape the blade 5 so that it widens powerfully at the heel, and to sharpen the said widening border 7. Thus it can be insured that the cut-off slices are really cut off at the end of the object to be chopped when chopping tree cuttings, branches or other tough and narrow pieces. It is advantageous to manufacture the widening member 7 as a separate part of the blade, which makes its production easier and more economic. The heel part can also suitably be made as a stationary member of the blade wheel.

The invention has above been explained by referring to only one preferred embodiment thereof. It is naturally clear that the invention is not to be limited only to said example, but that several modifications are possible within the scope of the following patent claims. Thus the moving blade can also move back and forth and be run for example by a hydraulic cylinder. Even when employing a rotating blade, it is of course possible to vary the form of running power to be used. For instance an electric motor or a combustion engine is perfectly suitable as a power source for the chopper according to the invention.

What is claimed is:

1. A wood chopper for splitting and cutting wood comprising:

a fixed blade adapted to receive a piece of wood thereon, the fixed blade having a cutting edge extending transversely to a major axis of the piece of wood when the wood is on the fixed blade;

a movable blade having a splitting edge extending substantially transversely to the cutting edge of said fixed blade, said movable blade increasing in width in a direction away from said splitting edge; and drive means connected to said movable blade for moving said splitting edge in a path adjacent to, on one side of and past said cutting edge, so that a piece of wood received on said cutting edge is split by said splitting edge when said splitting edge moves past said cutting edge, and cut by said cutting edge.

2. A wood chopper according to claim 1 wherein said fixed blade cutting edge is V-shaped.

3. A wood chopper according to claim 2, wherein said movable blade increases in width in a direction away from said splitting edge thereof, into a heel portion of said movable blade, said heel portion being wider than a greatest width of said V-shaped cutting edge.

4. A wood chopper according to claim 1, wherein said movable blade increases in width in a direction away from said splitting edge toward a heel portion of said movable blade, said heel portion being sharp and comprising at least one movable cutting edge which is movable by said drive means adjacent and past one side of said fixed blade cutting edge to cooperate therewith in cutting a piece of wood.

5. A wood chopper according to claim 4, wherein said movable cutting edge of said movable blade heel portion is a separate member attached to said movable blade.

6. A wood chopper according to claim 1, including a body plate, an opening through said body plate, said fixed blade defined on at least a part of said opening, said cutting edge of said fixed blade narrowing in a direction of movement of said movable blade as said movable blade is moved by said drive means.

7. A wood chopper according to claim 1, including a body plate, a blade wheel rotatably mounted to said body plate and carrying said movable blade, said drive means connected to said blade wheel for rotating said blade wheel.

8. A wood chopper according to claim 7, wherein said blade wheel comprises a circular driven wheel having an opening therein, said movable blade mounted to said blade wheel so that said splitting edge and at least a portion of said moving blade which increases in width extends into said blade wheel opening.

9. A wood chopper according to claim 8, wherein said movable blade increases in width toward a heel portion of said blade wheel, said heel portion of said blade wheel forming at least one sharpened movable cutting edge in said blade wheel opening.

* * * * *